US008328572B2

(12) United States Patent
Tashiro

(10) Patent No.: US 8,328,572 B2
(45) Date of Patent: Dec. 11, 2012

(54) CONNECTOR

(75) Inventor: Harunori Tashiro, Makinohara (JP)

(73) Assignee: Yazaki Corporation, Tokyo (JP)

( * ) Notice: Subject to any disclaimer, the term of this patent is extended or adjusted under 35 U.S.C. 154(b) by 56 days.

(21) Appl. No.: 13/124,202

(22) PCT Filed: Sep. 1, 2010

(86) PCT No.: PCT/JP2010/064913

§ 371 (c)(1),
(2), (4) Date: Apr. 14, 2011

(87) PCT Pub. No.: WO2011/027776

PCT Pub. Date: Mar. 10, 2011

(65) Prior Publication Data

US 2011/0207354 A1 Aug. 25, 2011

(30) Foreign Application Priority Data

Sep. 1, 2009 (JP) ..... P2009-201634

(51) Int. Cl.
*H01R 13/648* (2006.01)

(52) U.S. Cl. ..... 439/271

(58) Field of Classification Search ..... 439/271, 439/272, 587–589

See application file for complete search history.

(56) References Cited

U.S. PATENT DOCUMENTS

| | | | | |
|---|---|---|---|---|
| 5,622,512 | A * | 4/1997 | Uchida et al. | 439/271 |
| 6,910,905 | B2 * | 6/2005 | Tanaka et al. | 439/271 |
| 7,270,556 | B2 * | 9/2007 | Mori et al. | 439/272 |
| 2005/0014294 | A1 | 1/2005 | Ang et al. | |
| 2009/0197450 | A1 * | 8/2009 | Ooki et al. | 439/271 |

FOREIGN PATENT DOCUMENTS

| | | |
|---|---|---|
| JP | 202-313486 | 10/2002 |
| JP | 2002-313496 | 10/2002 |
| JP | 2005-129355 | 5/2005 |
| JP | 2005-276570 | 10/2005 |
| JP | 2007-103044 | 4/2007 |
| JP | 2009-021121 | 1/2009 |

OTHER PUBLICATIONS

International Search Report from the Japanese Patent Office for International Application No. PCT/JP2010/064913 (Mail date Oct. 5, 2010).

* cited by examiner

*Primary Examiner* — Gary F. Paumen
(74) *Attorney, Agent, or Firm* — Finnegan, Henderson, Farabow, Garrett & Dunner, L.L.P.

(57) ABSTRACT

A reduction in waterproofness that would occur when electric wires are bent is prevented.

There is provided a connector (1) comprising a housing (5) comprising a locking portion (11) and an insertion hole (19) into which an electric wire (17) is inserted, a seal material (7) through which the electric wire is inserted and which is inserted into the insertion hole in the housing, a rear holder (3) comprising a through hole (31) through which the electric wire penetrates and a locking portion which is brought into engagement with the locking portion of the housing and provided integrally on the housing with the locking portion locked on the locking portion of the housing so as to prevent the seal material inserted in the insertion hole in the housing from being dislodged from the housing, and a shell (9) comprising an accommodating portion (37) which accommodates the housing in an interior thereof and a locking portion (15) which is brought into engagement with the locking portion of the housing and provided integrally on the housing with the locking portion locked on the rear holder and the locking portion of the housing.

4 Claims, 10 Drawing Sheets

CONNECTOR

TECHNICAL FIELD

The present invention relates to a connector and more particularly to a connector including a housing into which an electric wire is inserted, a seal material, a rear holder and a shell which covers these constituent parts.

BACKGROUND ART

FIG. 8 is a perspective view of a conventional connector 200, FIGS. 9, 10 are partly sectional perspective views of the conventional connector 200, and FIG. 11 is a perspective view of the conventional connector 200 with a shell 202 removed.

The conventional connector 200 is a motor connector which is attached directly to a motor of an HEV (Hybrid Electric Vehicle), for example, and includes a housing 204, the aluminum shell 202, a packing 206 and rubber plugs 208.

The motor of the HEV is provided in an engine compartment of the vehicle and needs to be waterproofed, and therefore, the packing 206 is provided in a portion on a front surface of the connector 200 which contacts a housing of the motor (a front surface portion of the housing 204). In addition, the rubber plugs 208 through which electric wires 210 penetrate are provided in an electric wire 210 (a terminal 212) inserting portion at the rear of the housing 204. This waterproofs an interior of the housing 204.

In addition, the aluminum shell 202 is provided in the connector 200. The aluminum shell 202 is made of aluminum or aluminum alloy so as to remove noise generated at an electric connecting portion where a large electric current flows and is provided so as to cover the housing 204. Additionally, the aluminum shell prevents a rearward dislodgement of the rubber plugs 208 placed in the housing 204.

Namely, holes 214, which each have an inside diameter smaller than an outside diameter of the rubber plug 208 which waterproofs the rear of the connector 200, are provided in a rear end portion of the aluminum shell 202, and the aluminum shell 202 is placed from the rear of an assembly of the housing 204 and the rubber plugs 208. These holes 214 prevent the dislodgement of the rubber plugs 208, which are not crimped for attachment to the terminals 212 and the electric wires 210, to the rear of the housing 204. Note that the electric wires 210 penetrate through the holes 214 in the aluminum shells 202.

Here, for example, Patent Literature 1 and Patent Literature 2 can be raised as Patent Literatures regarding the related art.

CITATION LIST

Patent Literature

Patent Literature 1: JP-A-2002-313496
Patent Literature 2: JP-A-2005-129355

SUMMARY OF INVENTION

Technical Problem

Incidentally, in the conventional connector 200, although the rubber plugs (seal materials) 208 are held by the aluminum shell 202, when the electric wires 210 are bent, a force is exerted on the rubber plugs 208 from the electric wires 210 due to the bending of the electric wires 210, which generates eccentricity (deformation) in not only portions of the rubber plugs 208 which are exposed at the rear of the housing 204 or the aluminum shell 202 but also portions of the rubber plugs

208 which are situated in an interior of the housing 204, whereby the waterproofness in the interior of the housing 204 by the rubber plugs 208 is reduced. In order to prevent the transmission of the force of the electric wires 210 to the rubber plugs 208 so as to prevent the reduction in waterproofness due to the eccentricity of the rubber plugs 208, a countermeasure can be considered in which the electric wires 210 are held by a rear holder (which is not shown in FIGS. 8 to 11).

When a rear holder is provided in addition to the rubber plugs 208, however, a separate locking means is necessary for locking the rear holder on the housing 204, which makes the configuration of the connector complex.

In addition, the necessity of a space for provision of the locking means increases the size of the connector, leading to fears that the connector cannot be placed in a limited space.

The invention has been made in view of the problems above, and an object thereof is to provide a connector which can prevent the reduction in waterproofness (sealing capability) therein when an electric wire is bent with a simple configuration.

Solution to Problem

According to the invention, there is provided a connector, comprising:

a housing including a locking portion and an insertion hole into which an electric wire is inserted;

a seal material, formed in an annular shape, inserted into the insertion hole of the housing, and into which the electric wire is inserted;

a rear holder, provided integrally on the housing, and including:

a through hole through which the electric wire penetrates; and a rear holder locking portion which is brought into engagement with the locking portion of the housing, and locked on the locking portion of the housing so as to prevent the seal material inserted in the insertion hole of the housing from being dislodged from the housing and to support the electric wire which penetrates through the through hole and the insertion hole in the housing; and a shell, including an accommodating portion which accommodates the housing and the rear holder in an interior thereof and a shell locking portion which is brought into engagement with the locking portion of the housing, wherein the accommodating portion accommodates the housing and the rear holder and the shell locking portion is locked on the locking portion of the housing on which the rear holder locking portion is locked so that the shell is provided integrally on the housing.

The invention is a connector in which the shell restricts the dislodgement of the rear holder from the housing.

The invention is a connector in which the rear holder projects further than the housing and the shell so as to cover the circumference of the electric wire on a side where the electric wire extends.

The invention is a connector in which a plurality of insertion holes into which a plurality of electric wires are inserted are aligned in the housing, a plurality of through holes into which the plurality of electric wires are inserted are aligned in the rear holder, and a plurality of locking portions are provided and are disposed between the insertion holes at an outer periphery of the housing.

Advantageous Effects of Invention

According to the invention, there is provided an advantage that there can be provided a connector which can prevent the reduction in waterproofness (sealing capability) therein when an electric wire is bent with a simple configuration.

DESCRIPTION OF EMBODIMENTS

Figure 1:
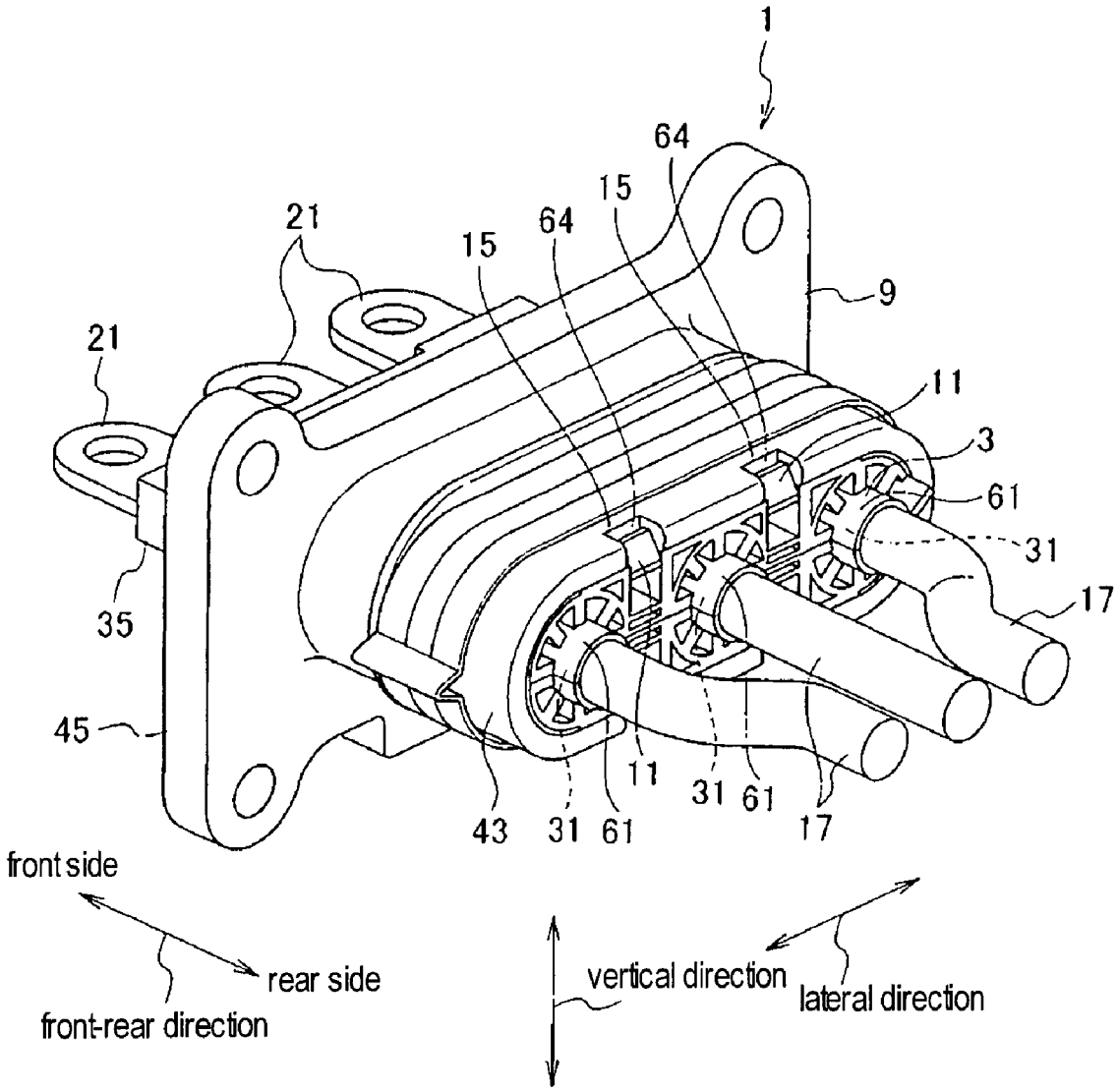
FIG. 1 is a perspective view showing a schematic configuration of a connector according to an embodiment of the invention.
Figure 2:
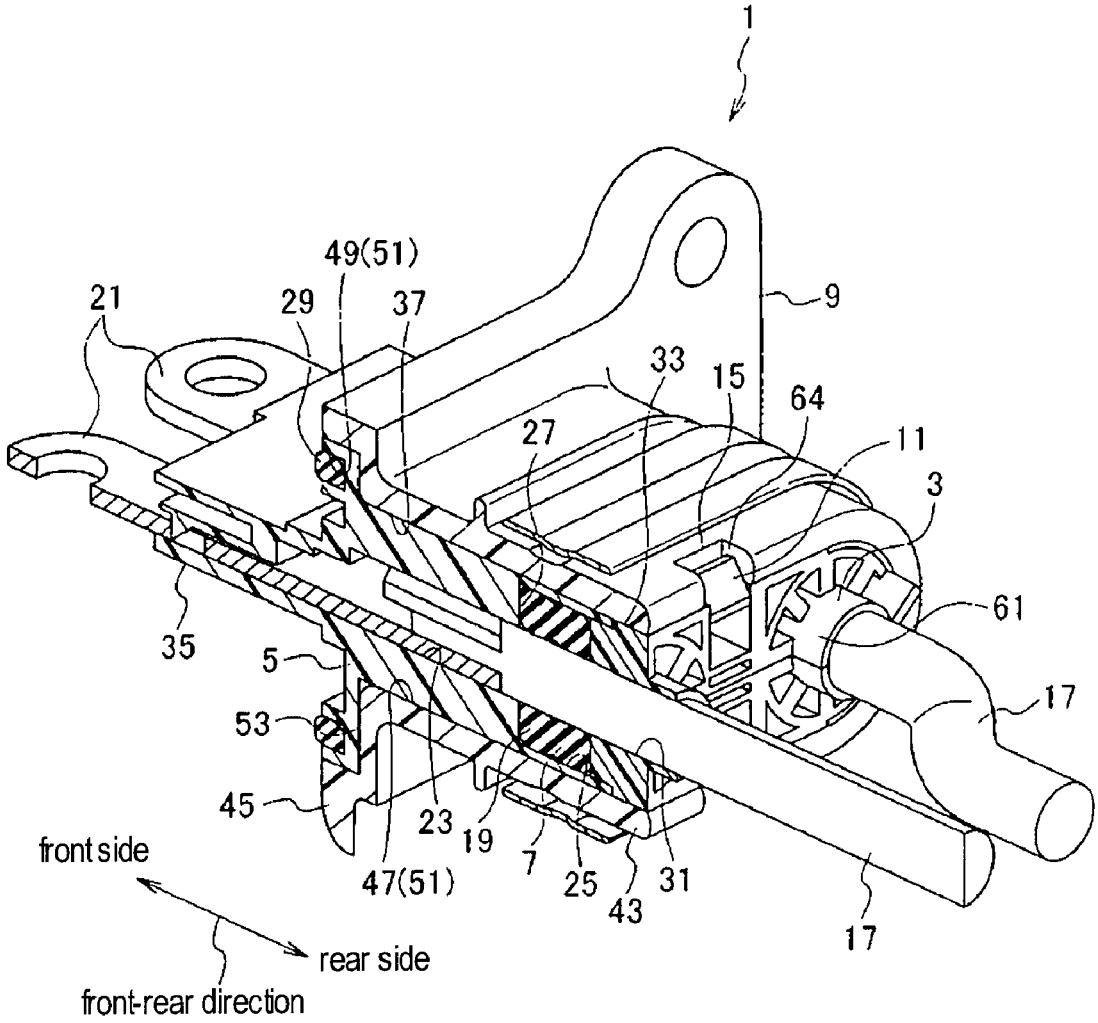
FIG. 2 is a partly sectional perspective view of the connector.
Figure 3:
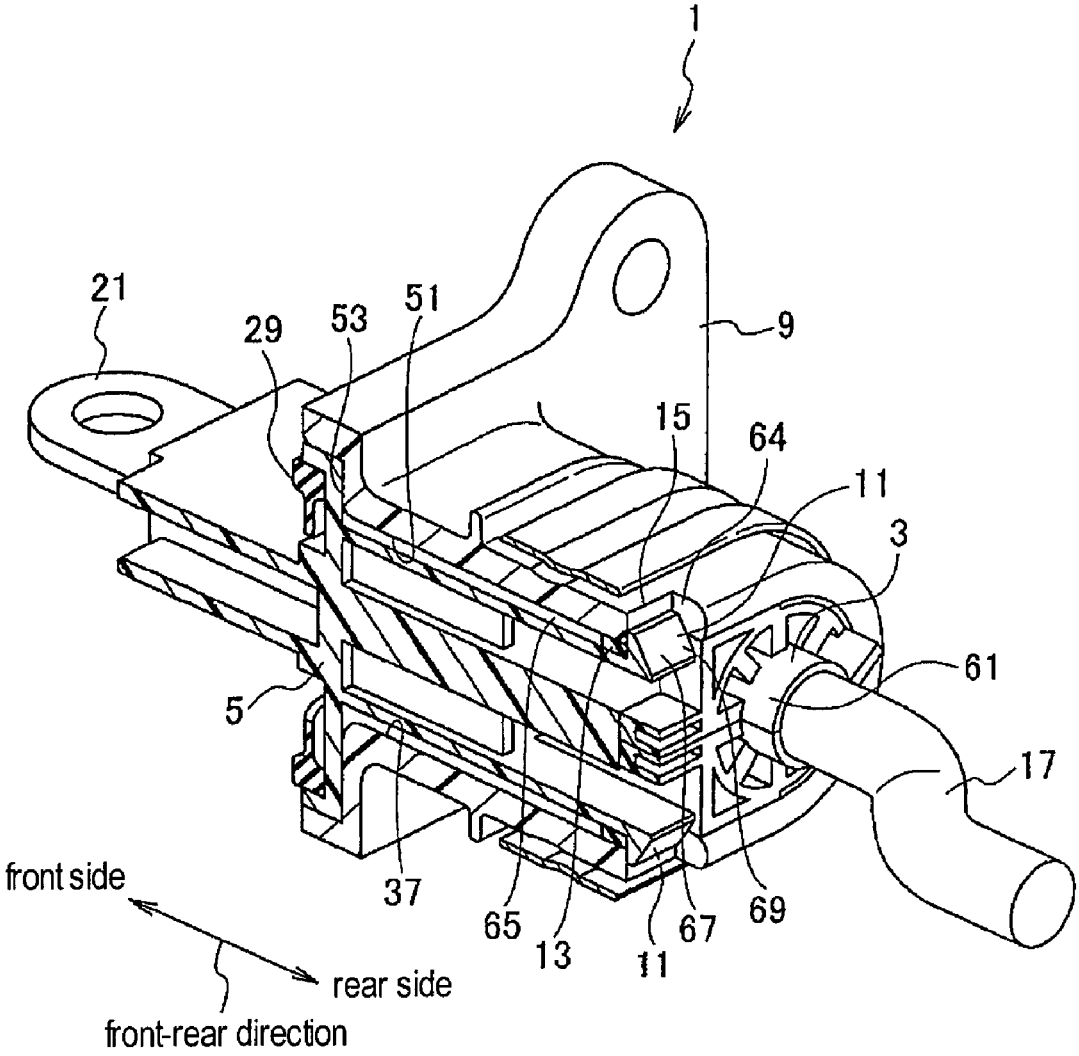
FIG. 3 is a partly sectional perspective view of the connector.
Figure 4:
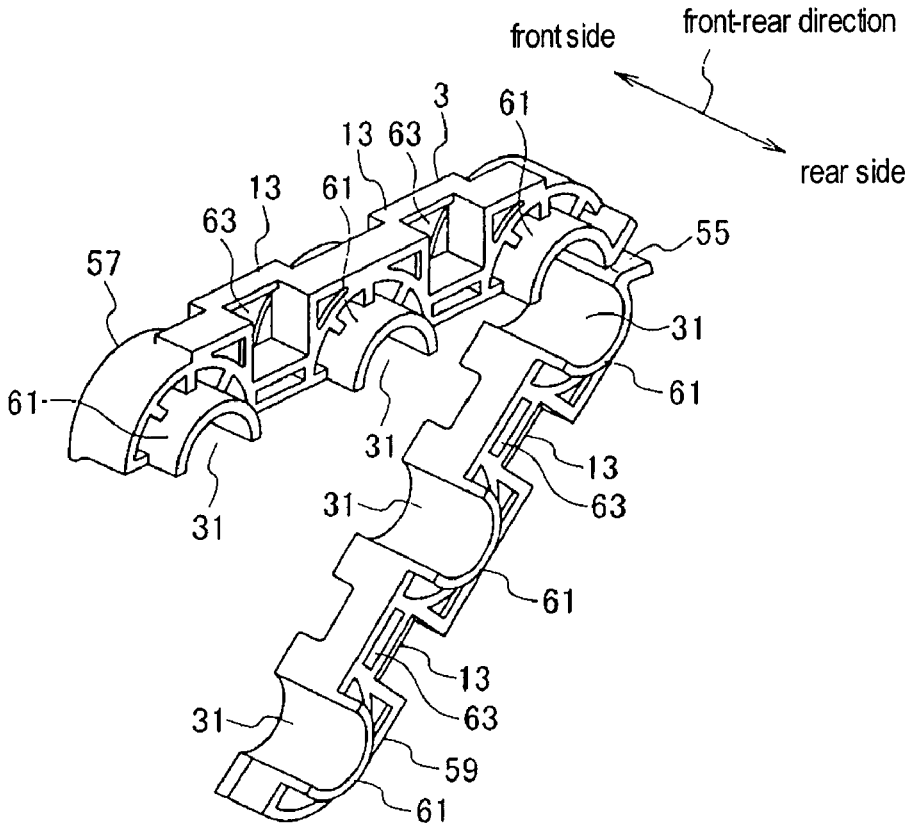
FIG. 4 is a perspective view showing a schematic configuration of a rear holder.

FIG. 1 is a perspective view showing a schematic configuration of a connector 1 according to an embodiment of the invention, FIGS. 2 and 3 are partly sectional perspective views of the connector 1, and FIG. 4 is a perspective view showing a schematic configuration of a rear holder 3.

As with the conventional connector 200, the connector 1 is a motor connector which is attached directly to a motor of an HEV and includes a housing 5, seal materials 7, a rear holder 3 and a shell 9.

Specifically, in the housing 5 made of a resin having insulation characteristics, for example, there are provided locking portions 11 which are brought into engagement with locking portions 13 of the rear holder 3 and locking portions 15 of the shell 9, which will be described later, and insertion holes (through holes) 19 into which electric wires (electric wires for supplying electric power to the motor) 17.

Here, as a matter of convenience in description, a longitudinal direction of the electric wire 17 which is inserted into the housing 5 (a penetrating direction of the electric wire 17 through the insertion hole 19) is referred to as a front-rear direction of the connector 1 (the housing 5, the seal materials 7, the rear holder 3, the shell 9). In particular, a motor side of the connector 1 is referred to as a front side, and an opposite side of the connector 1 to the motor (a side from which the electric wires 17 extend) is referred to as a rear side of the connector 1. In addition, a direction in which the through holes (three cylindrical through holes) 19 are provided side by side in the connector 1 is referred to as a lateral direction, and a direction which intersects the front-rear direction and the lateral direction at right angles is referred to as a vertical direction.

In the electric wire 17, for example, a section taken along a plane which intersects the longitudinal direction at right angles has a circular shape, and a conductor made of metal such as copper is coated with an insulation material such as resin. A terminal (a terminal corrected directly to the motor) 21 is provided integrally at a front end portion of the electric wire 17 which is one of longitudinal end portions thereof. In addition, the electric wire 17 is inserted into the insertion hole 19 from the rear side of the housing 5 with the terminal 21 disposed at the front of the electric wire 17.

The insertion hole 19 includes a cylindrical small-diameter portion 23 which is positioned at a front portion and a cylindrical large-diameter portion 25 which is positioned at a rear portion thereof. An axis of the small-diameter portion 23 and an axis of the large-diameter portion 25 coincide with each other, and an inside diameter of the small-diameter portion is equal to or slightly larger than an outside diameter of the electric wire 17. In addition, a riser 27, which is made up of a ring-shaped plane (a plane which intersects the front-rear direction at right angles), is formed at a boundary between the small-diameter portion 23 and the large-diameter portion 25.

The locking portion 11 is used to install integrally the rear holder 3 and the shell 9 on the housing 5 and is provided at the rear side of the housing 5 (further rearwards than the riser 27). In the electric wire 17 inserted into the housing 5, the terminal 21 projects from the housing 5 at the front side of the housing 5, and the electric wire 17 extends from the housing 5 at the rear side of the housing 5. The seal material (a seal material made of an elastic material such as rubber; for example an O-ring) 7 having a ring-like shape is provided at a front-side surface of the housing 5 so as to surround the insertion hole 19 and the projecting terminal 21.

The seal material (for example, a rubber plug) 7 is formed into an annular shape. Namely, the seal material 7 takes a form resulting from removing a small cylinder from a large cylinder. Note that the large cylinder and the small cylinder are equal in height but different in diameter from each other, have axes which coincide with each other, and are both situated at the same position in their height direction.

For example, the seal material 7 is inserted into the insertion hole 19 so that an outer circumference ○ the seal material 7 comes into contact with an inner wall of the large-diameter portion 25 of the insertion hole 19 in the housing 5 along the full circumference thereof, whereby the seal material 7 is installed in the housing 5. An inner circumference of the seal material 7 which is installed in the housing 5 is in contact with an outer circumference of the electric wire 17 inserted into the insertion hole 19 in the housing 5 along the full circumference thereof.

By these contacts, the seal material 7 and the electric wire 17 (the electric wire positioned inside the seal material 7) are restricted from moving relative to the housing 5. Namely, the seal material 7 and the electric wire 17 are fixed to the housing 5 in a radial direction of the seam material 7. In addition, one end portion of the seal material 7 in an extending direction of an axis thereof is in contact with the riser (the riser between the small-diameter portion 23 and the large-diameter portion 25) 27.

The rear holder 3, which is made of, for example, a resin having insulation characteristics, includes a through hole (a cylindrical through hole whose inside diameter is equal to or slightly larger than the outside diameter of the electric wire 17) 31 through which the electric wire 17 penetrates and locking portions 13 which are locked on the locking portions 11 of the housing 5.

Then, the rear holder 3 is provided integrally on the housing 5 with the locking portions 13 locked on the locking portions 11 of the housing 5 so as not only to prevent the dislodgement of the seal materials 7 which are inserted into the insertion holes 19 in the housing 5 from the housing 5 and to support the electric wires 17 which penetrate through the corresponding through holes 31 therein and the corresponding insertion holes 19 in the housing 5.

Here, a state in which the seal materials 7 and the rear holder 3 are installed in and on the housing 5 (a seal materials-rear holder 3 installed state) will be described.

In the seal materials and rear holder installation state, portions of the rear holder 3 lying on one side thereof (portions (front side portions) lying on one side in a direction in which the through holes are opened and each having an annular shape whose outside diameter is substantially equal to an inside diameter of the large-diameter portion 25 of the insertion hole 19 in the housing 5) 33 enter the corresponding large-diameter portions 25. By this configuration, in a radial direction of the rear holder 3, the rear holder 3 is restricted from moving relative to the housing 5. Namely, in the radial direction of the rear holder 3, the rear holder 3 is fixed to the housing 5.

In addition, in the seal materials-rear holder installed state, as has been described above, one axial end portions of the seal materials 7 are in contact with the risers 27 which are positioned at the boundaries between the large-diameter portions 25 and the small-diameter portions 23 in the housing 5, and side surfaces of the portions on the one side of the rear holder 3 are in abutment with the other axial end portions of the seal materials 7. Additionally, the locking portions 13 of the rear holder which are provided on the other side of the rear holder 3 are in engagement with the locking portions 11 on the housing 5.

By this configuration, the seal materials 7 and the rear holder 3 are held by the risers 27 in the insertion holes 19 in the housing 5 and the locking portions 11 of the housing 5 therebetween, and in an axial direction of the seal materials 7 and the rear holder 3 (in the front-rear direction of the housing 5), the seal materials 7 and the rear holder 3 are restricted from moving relative to the housing 5. Namely, in the axial direction of the seal materials 7 and the rear holder 3, the seal materials 7 and the rear holder 3 are fixed to the housing 5.

Thus, the seal materials 7 and the rear holder 3 installed in and on the housing 5 are provided integrally in and on the housing 3 without fears that the seal materials 7 and the rear holder 3 are dislodged from the housing 5.

Incidentally, in such a state that the electric wires 17 and their terminals 21 are installed in the connector 1, the terminals 21, which are provided integrally on the corresponding electric wires 17, are held by corresponding terminal holding portions 35 which are provided on the front side of the housing 5, whereby the terminals 21 and the electric wires 17 are provided integrally in the housing 5. In addition, the electric wires 17 are restricted from being dislodged from the connector 1.

The shell 9, which is similar to the aluminum shell 202 of the conventional connector 200, is made of metal or a conductive material such as aluminum or an alloy thereof and is provided so as to cover the housing 5.

In addition, the shell 9 includes an accommodating portion 37 which accommodates in an interior portion thereof the housing 5, the seal materials 7 which are installed in the housing 5 and the rear holder 3 which is installed on the housing 5, and locking portions 15 which are brought into engagement with the locking portions 11 of the housing 5.

Thus, the housing 5, and the seal materials 7 and the rear holder 3 which are installed in and on the housing 5 are accommodated within the accommodating portion 37, and the locking portions 15 are locked on the locking portions 11 of the housing 5 on which the locking portions 13 of the rear holder 3 are locked, whereby the shell 9 is provided integrally on the housing 5 and the rear holder 3.

Namely, the locking portions 11 of the housing 5 which are in engagement with the locking portions 13 of the rear holder 3 still have a residual engagement margin, and the locking portions 11 of the housing 5 which are in engagement with the locking portions 13 of the rear holder 3 can further be brought into engagement with the locking portions 15 of the shell 9. Consequently, in such a state that the seal materials 7, the rear holder 3 and the shell 9 are installed in and on the housing 5, one locking portion 11 of the housing 5 is in engagement with both one locking portion 13 of the rear holder 3 and one locking portion 15 of the shell 9.

Here, the engagement state of the shell 9 with the housing 5 and the rear holder 3 in the seal materials-rear holder installed state will be described further.

In the seal materials-rear holder installed state, the housing 5 and the rear holder 3 are configured as a form which includes a cylindrical portion 39 and a flange portion (a flange portion formed on the housing 5) 41 which is provided at one end portion side (a front side) of the cylindrical portion 39.

The electric wires 17 with the terminal penetrate through the cylindrical portion 39 and the flange portion 41, and the terminals 21 project to the front side from the flange portion 41, while the electric wires 17 extend to the rear side from the cylindrical portion 39 (the rear holder 3). The shell 9 includes a cylindrical portion 43 and a flange portion 45 which is provided at one end portion side (a front side) of the cylindrical portion 43.

The accommodating portion 37 of the shell 9 is made up of a through hole (a through hole penetrating in the front-rear direction of the shell 9) 51 which includes a small-diameter portion 47 and a large-diameter portion 49. An inside diameter of the small-diameter portion 47 of the through hole 51 is substantially equal to an outside diameter of the cylindrical portion 39 of the housing 5 and the rear holder 3. An inside diameter of the large-diameter portion 49 of the through hole 51 is substantially equal to an outside diameter of the flange portion 41 of the housing 5 and the rear holder 3 or larger than the outside diameter of the flange portion 41.

In addition, the large-diameter portion 49 of the through hole 51 is provided at the front side of the shell 9 (the side where the flange portion 45 is formed), and a depth value of the large-diameter portion 49 of the through hole 51 is smaller than a thickness value of the flange portion 45 of the shell 9 and is substantially equal to a thickness value of the flange portion 41 of the housing 5. Further, a riser 53, which is made up of a ring-shaped plane (a plane which intersects the front-rear direction at right angles), is formed at a boundary between the large-diameter portion 49 and the small-diameter portion 47 of the shell 9.

Thus, in the connector 1, an outer circumference of the cylindrical portion 39 of the housing 5 and the rear holder 3 is in contact with an inner circumference of the small-diameter portion 47. By this configuration, the shell 9 is restricted from moving relative to the housing 5 and the rear holder 3 in a radial direction of the housing 5 and the rear holder 3.

In addition, in the connector 1, the flange portion 41 of the housing 5 is in contact with the riser 53 of the shell 9, and the locking portions 15 of the shell 9 which are provided on the other end side of the shell 9 are in engagement with the locking portions 11 of the housing 5. By this configuration, the shell 9 is held by the flange portion 41 and the locking portions 11 of the housing 5 therebetween, and the shell 9 is restricted from moving relative to the housing 5 and the rear holder 3 in an axial direction of the shell 9 (the front-rear direction of the housing 5 and the shell 9). By this configuration, the shell is installed integrally on the housing 5.

Incidentally, the connector 1 is installed integrally on the motor so that respective front surfaces of the flange portions 41, 45 are brought into contact with a housing of the motor.

The installation of the connector 1 onto the motor is implemented by causing bolts to penetrate through holes provided in the housing 5.

In such a state that the connector 1 in which the electric wires 17 with the terminal 21 are installed is installed integrally on the motor, as with the conventional connector 200, a seal material 29 and the seal materials 7 prevent water or the like from entering the interior of the housing 5.

In the connector 1, the shell 9 restricts the dislodgement of the rear holder 3 from the housing 5. In addition, the locking portions 15 of the shell 9 fasten the locking portions 13 of the rear holder 3 from the outside, and the locking portions 15 of the shell 9 cover the locking portions 13 of the rear holder 3.

In addition, in the connector 1, the rear holder 3 projects further than the housing 5 and the shell 9 to cover the circumferences of the electric wires 17 so as to be in contact with the electric wires 17 for support.

Further, the plurality of (for example, three) insertion holes 19 and through holes 31 into which the plurality of (for example, three) electric wires 17 are inserted are provided side by side in the housing 5 and the rear holder 3, respectively, of the connector 1, and the seal materials 7 are installed in the corresponding insertion holes 19. Respective axes of the insertion holes 19 in the housing 5 are parallel to one another, and respective positions of the insertion holes 19 in a penetrating direction of the insertion holes 19 coincide with one another. In addition, the insertion holes 19 are aligned in a row at predetermined intervals. The through holes 31 in the rear holder 3 are also provided similarly.

In addition, the plurality of locking portions 11 are provided on the housing 5, the plurality of locking portions 13 are provided on the rear holder 3, and the plurality of locking portions 15 are provided on the shell 9. Additionally, the locking portions 11 disposed between the insertion holes 19 on an outer circumference of the housing 5.

To describe further, the rear holder 3 is formed into a "V" shape by a first portion 57 and a second portion 59 which are so disposed with a hinge portion disposed therebetween which is formed at one end portion in the lateral direction of the rear holder 3. When the rear holder 3 is installed on the housing 5, the first portion 57 and the second portion 59 are closely attached to each other, whereby the rear holder 3 is formed into an "I" shape. Hereinafter, the rear holder 3 which is formed into the "I" shape will be described in detail.

When looked at from the front-rear direction, the rear holder 3 is formed into an elliptic shape (the "I" shape) which is long in the lateral direction and of which both end portions are formed into a semicircular shape. The three through holes 31 in the rear holder 3 are each formed into a circular shape (a cylindrical shape) and are aligned in the lateral direction of the rear holder 3 at predetermined intervals.

The portions 33 which fittingly enter the insertion holes 19 in the housing 5 are provided at the front side in the front-rear direction of the rear holder 3, while cylindrical electric wire support portions 61 which support the corresponding electric wires 17 are formed at the rear side in the front-rear direction of the rear holder 3.

The locking portions 13 which are brought into engagement with the locking portions 11 of the housing 5 are formed between the through holes 31 at an intermediate portion in the front-rear direction of the rear holder 3. The locking portions 13 are formed by through holes 63, for example, and are provided at end portions in a vertical direction of the rear holder 3.

The cylindrical portion 43 of the shell 9 is also formed into an elliptic shape in a similar fashion to the rear holder 3, and cutout portions 64 which form the locking portions 15 are provided at both end portions in the vertical direction and at a rear end of the cylindrical portion 43 of the shell 9.

The cylindrical portion 39 of the housing 5 is also formed into an elliptic shape in the similar fashion to the rear holder 3, and the locking portions 11 are provided at both end portions in the vertical direction so as to extend from a rear end of the cylindrical portion 39 of the housing 5.

To describe further, the locking portion 11 of the housing 5 includes a lock beak 67 which is provided at a distal end of a lock arm 65 which extends to the rear of the housing 5. The lock beak 67 is formed into a right triangular prism which includes a sloping surface 69 at a distal end portion and projects slightly from the lock arm 65 in the vertical direction of the housing 5 on an external side (a side which deviates from a center) of the housing 5.

In an intermediate state of installing the rear holder 3 on the housing 5, the lock beaks 67 are brought into abutment with the rear holder 3, whereby the lock arms 65 are deformed elastically inwards of the housing 5. When the rear holder 3 is completely installed on the housing 5, the lock arms 65 are restored, and the lock beaks 67 (side portions of proximal end portions of the lock beaks 67) pass through the through holes 63 in the rear holder 3 so as to be brought into abutment with the locking portions 13 of the rear holder 3, whereby the seal materials 7 and the rear holder 3 are held by the risers 27 of the housing 5 and the lock beaks 67 therebetween and the lock beaks 67 project outwards of the rear holder 3 in the vertical direction to thereby form the engagement margins.

In the midst of installing the shell 9 on the housing 5 on which the rear holder 3 is installed, the lock beaks 67 are brought into abutment with an inner wall of the small-diameter portion 47 of the shell 9, whereby the lock arms 65 are deformed elastically inwards of the housing 5 in the similar fashion to the intermediate state of installing the rear holder 3 on the housing 5. With this elastic deformation only, the seal materials 7 and the rear holder 3 still continue to be held by the risers 27 of the housing 5 and the lock beaks 67 therebetween.

When the shell 9 is completely installed on the housing 5 on which the rear holder 3 is installed, the lock arms 65 are restored, and the lock beaks 67 (portions at the distal end portions of the lock beaks 67) are brought into engagement with the locking portions 15 of the shell 9 (the engagement margins of the portions at the proximal end portion sides of the lock beaks 67 are brought into abutment with the locking portions 13 of the rear holder 3, too), whereby the locking portions 13 of the rear holder 3 are held by the lock arms 65 (the portions at the distal end portion sides of the lock arms 65) and the locking portions 15 (the cylindrical portion 43) of the shell 9 which are positioned further outwards than the locking portions 13 of the rear holder 3. By this configuration, in the connector 1, the shell 9 restricts the dislodgement of the rear holder 3 from the housing 5. In addition, the locking portions 15 of the shell 9 fasten the locking portions 13 of the rear holder 3 from the outside, and the locking portions 15 of the shell 9 cover the locking portions 13 of the rear holder 3.

Next, a fabrication procedure of the connector 1 will be described.

Figure 5:
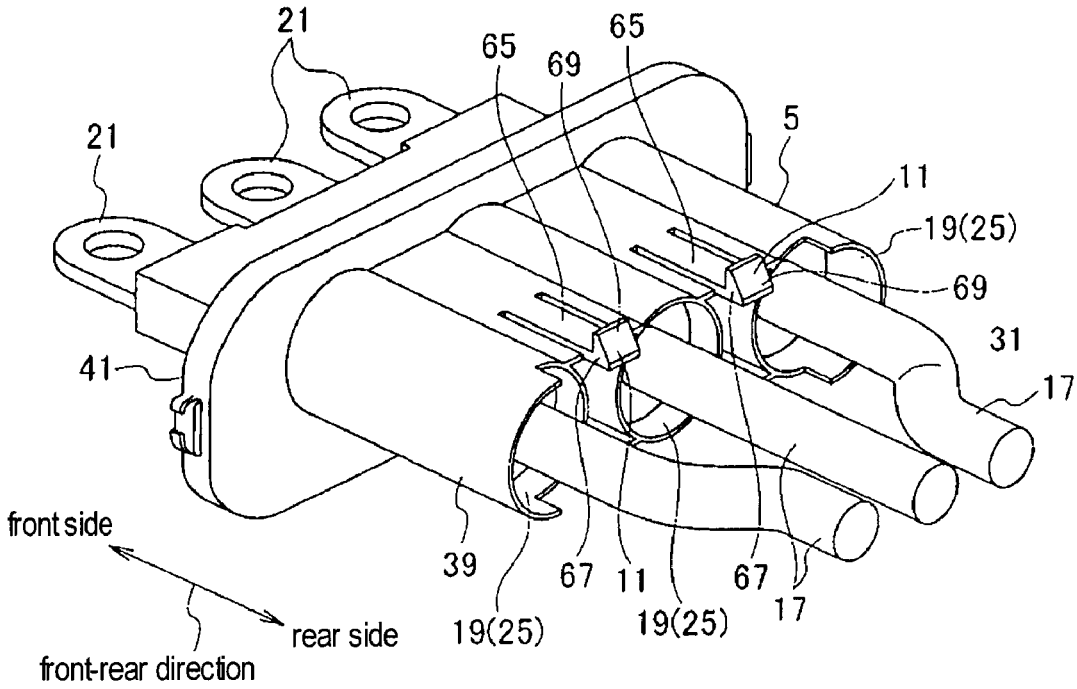
FIG. 5 is a perspective view depicting a summary of a fabrication procedure of the connector.
Figure 6:
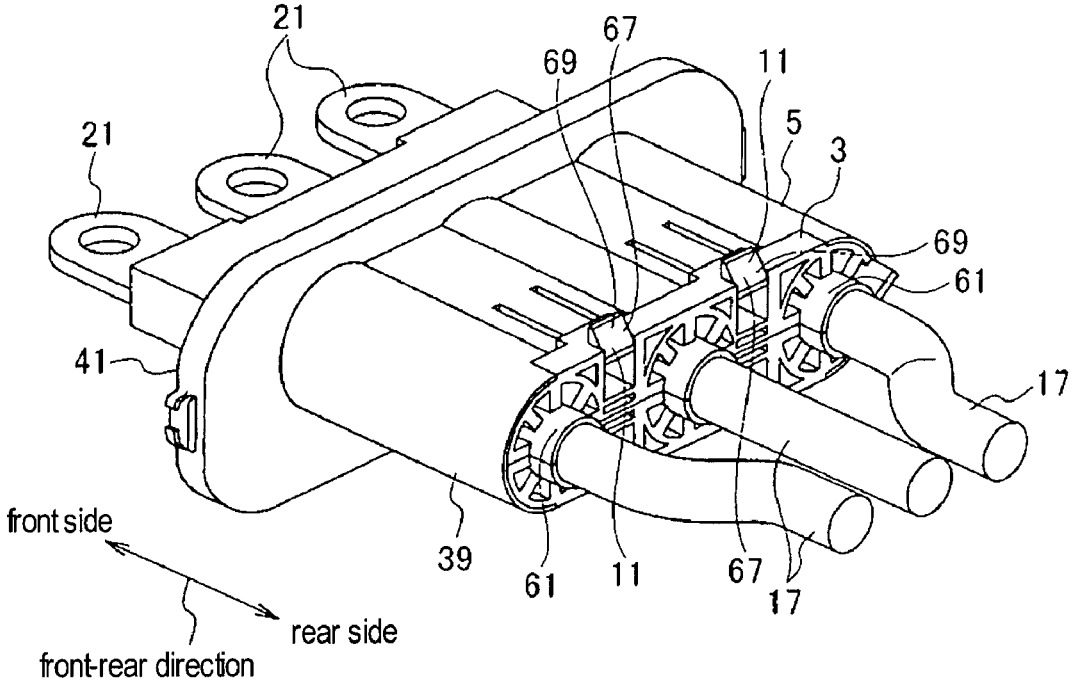
FIG. 6 is a drawing depicting the summary of the fabrication procedure of the connector.
Figure 7:
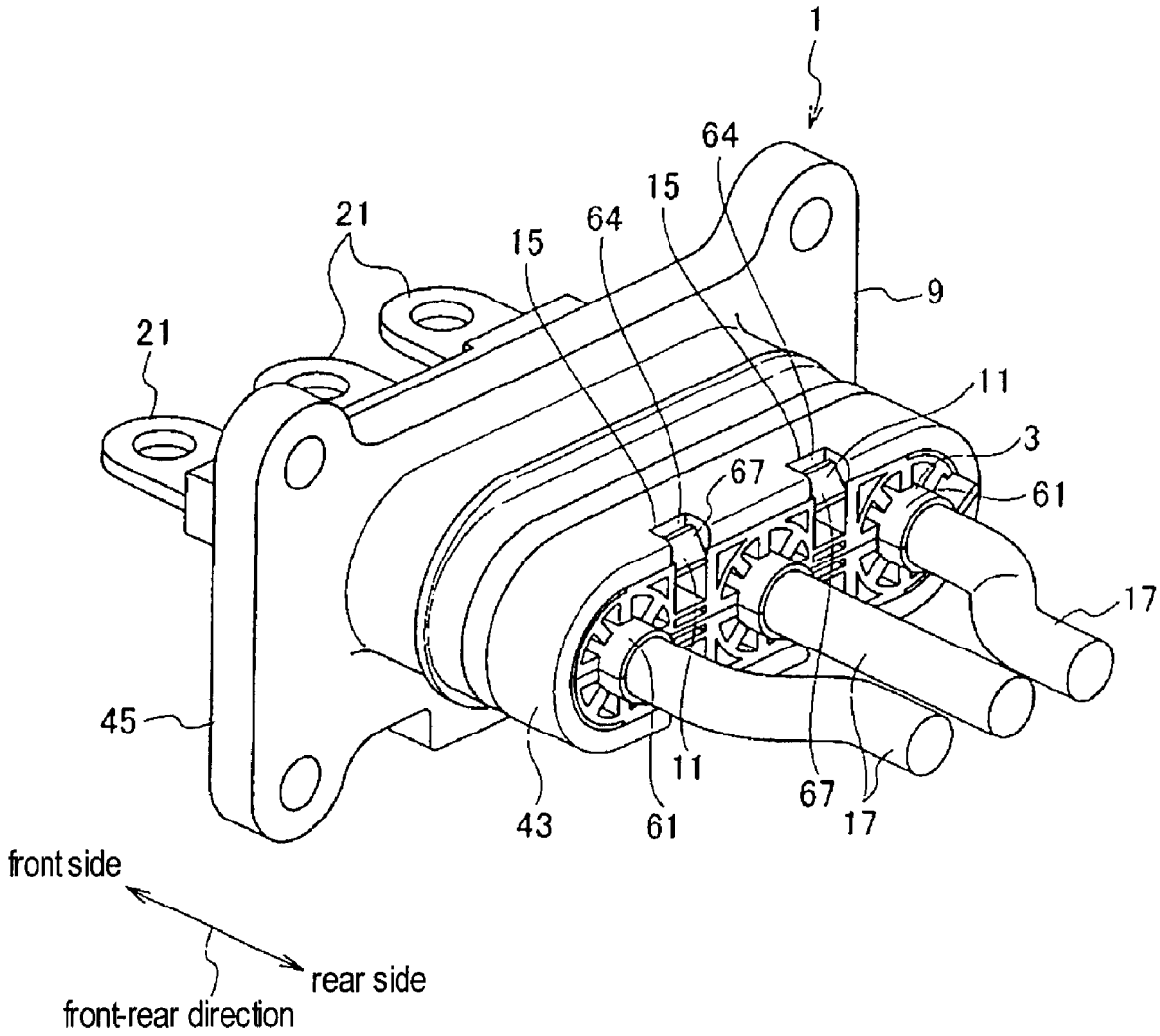
FIG. 7 is a drawing depicting the summary of the fabrication procedure of the connector.
Figure 8:
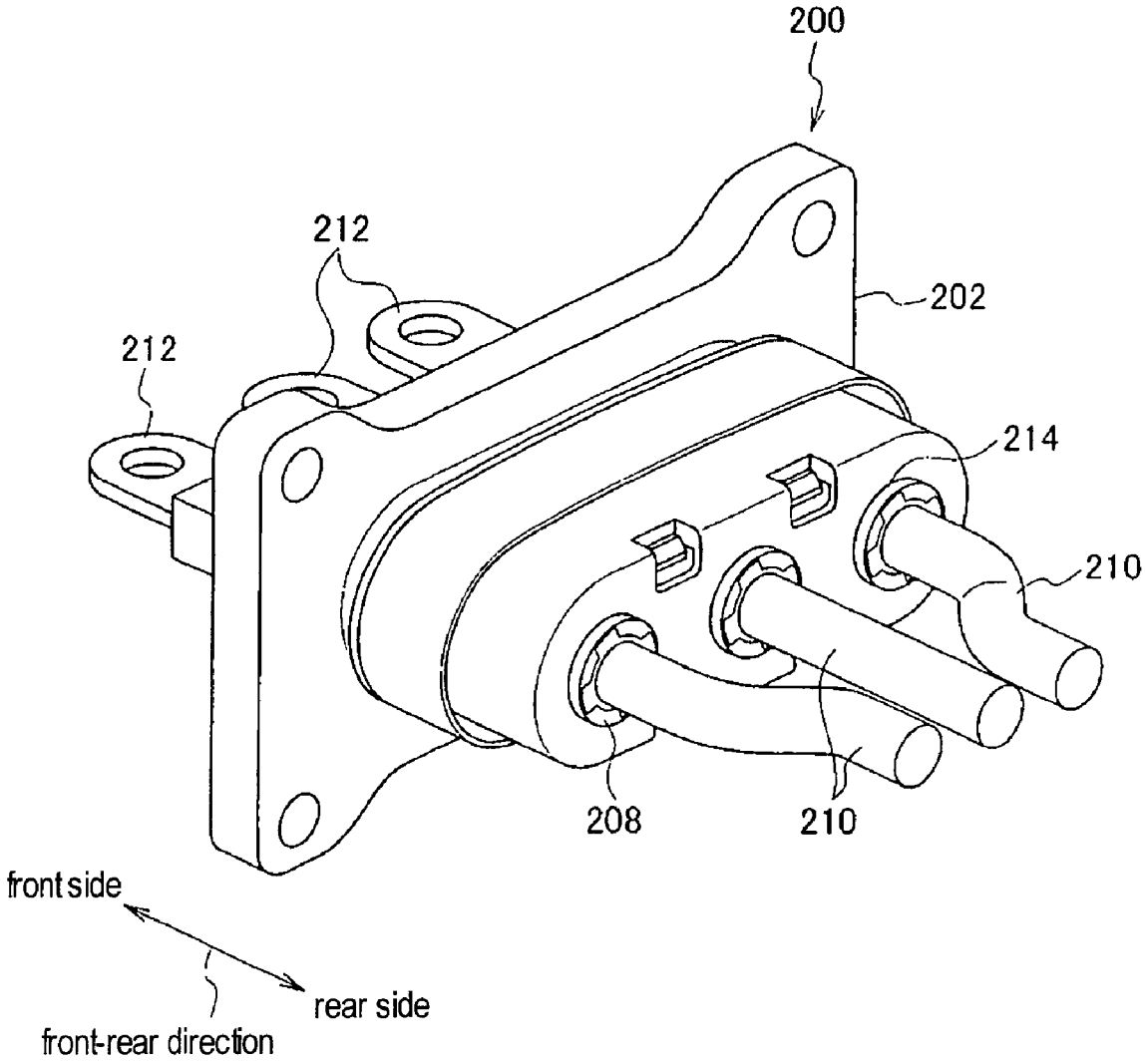
FIG. 8 is a drawing view of a conventional connector.
Figure 9:
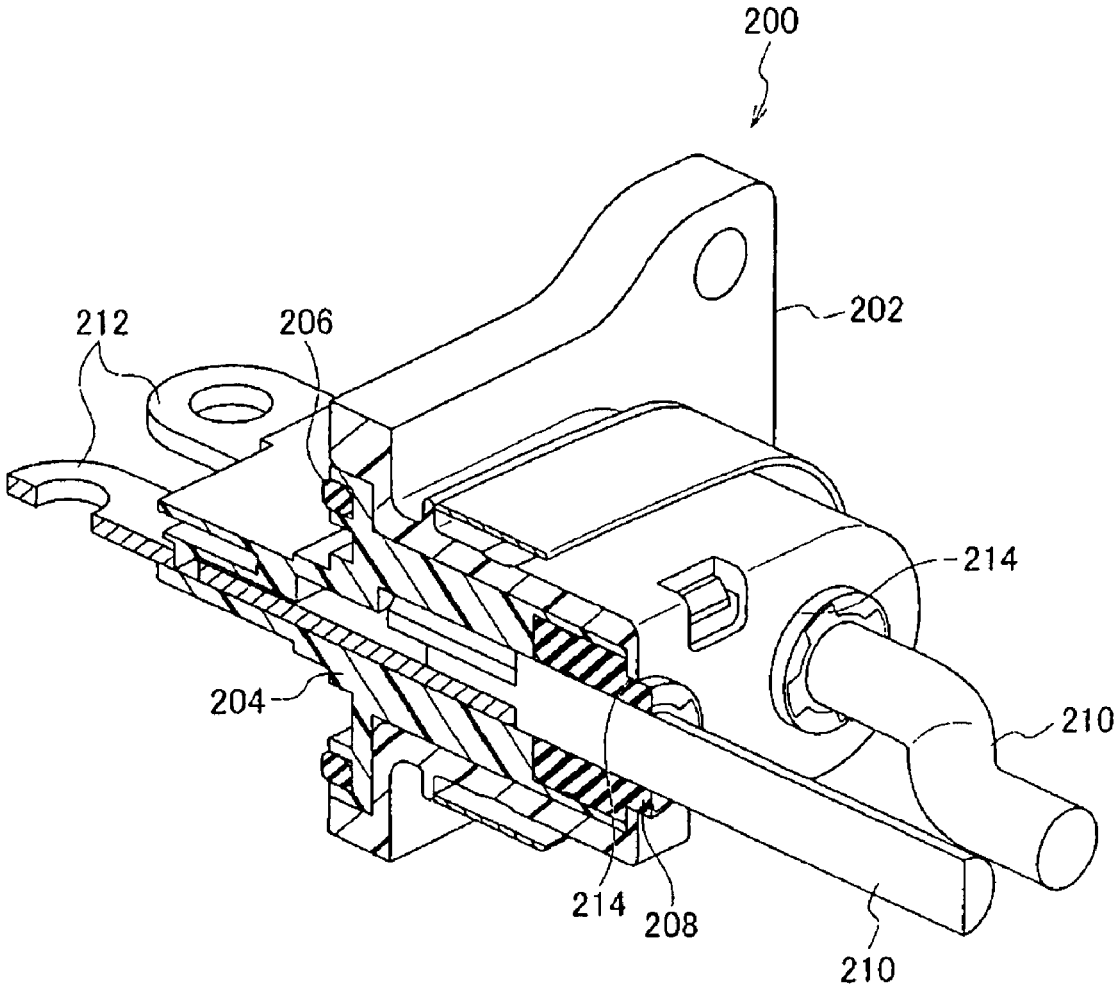
FIG. 9 is a partly sectional perspective view of the conventional connector.
Figure 10:
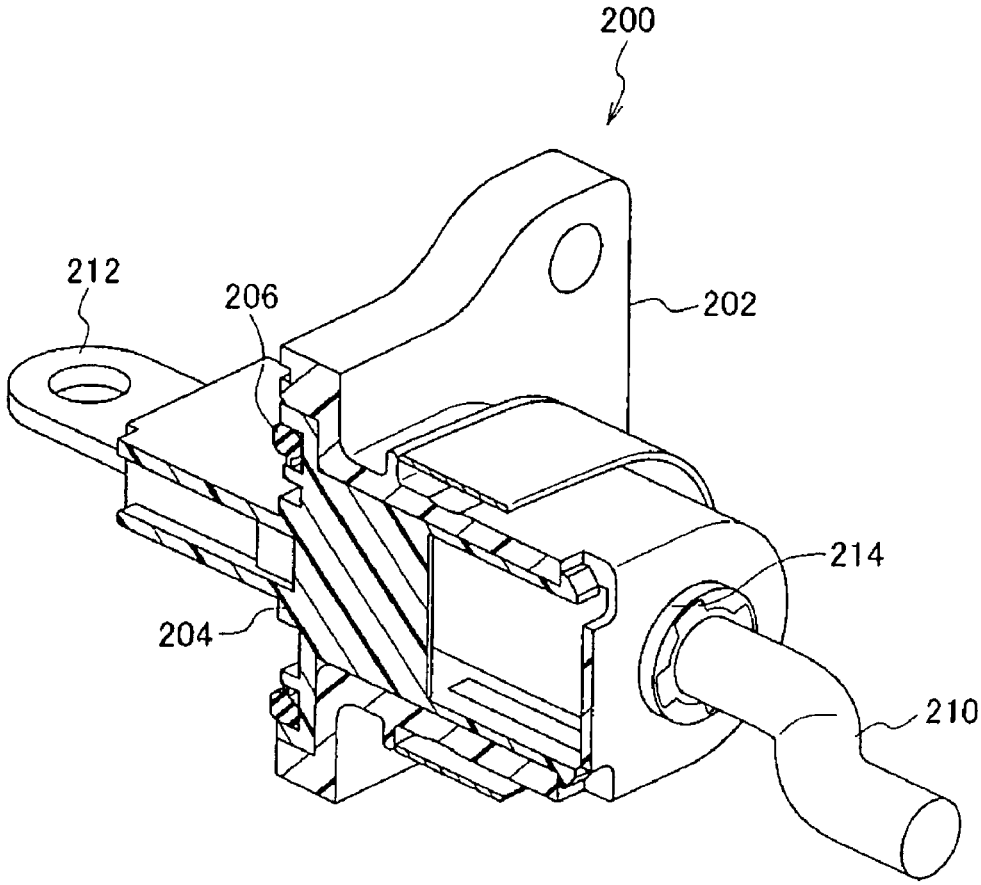
FIG. 10 is a partly sectional perspective view of the conventional connector.
Figure 11:
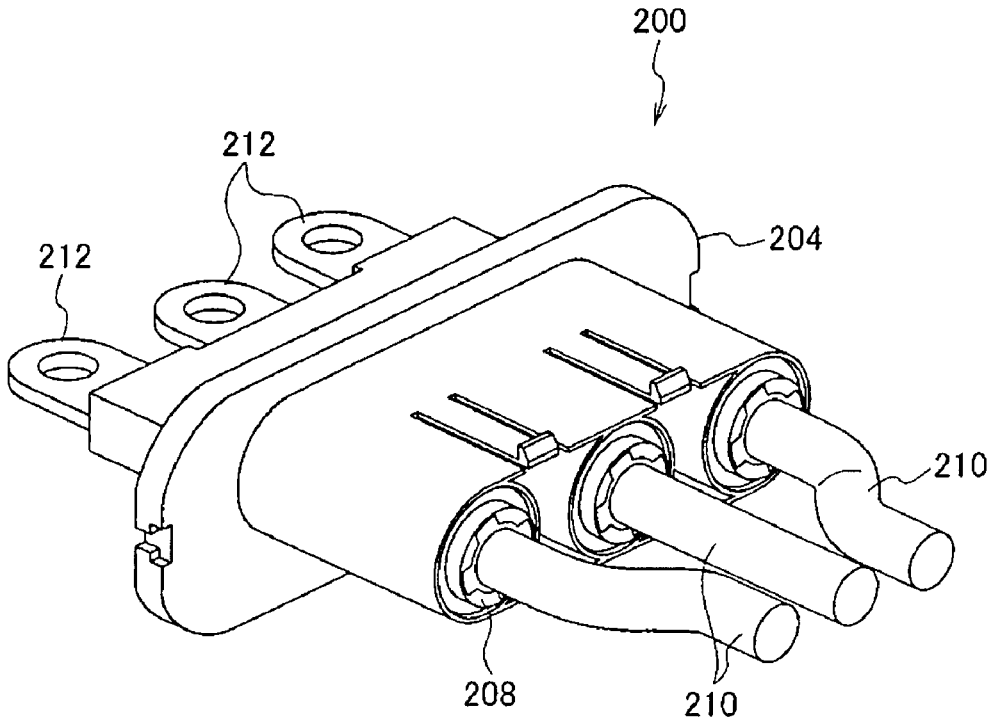
FIG. 11 is a perspective view of the conventional connector with a shell removed.

FIGS. 5, 6 and 7 are drawings depicting briefly the fabrication procedure of the connector 1.

Firstly, the electric wires 17 on which the terminals 21 are provided and which penetrate through the seal materials 7 are inserted into the insertion holes 19 from the rear of the housing 5 with the terminals 21 disposed at the front thereof, the terminals 21 are held by the terminal holding portions 35, and the seal materials 7 are installed in the large-diameter portions 25 of the insertion holes 19 (refer to FIG. 5).

Following this, the rear holder 3 is installed on the housing 5 from the rear of the housing 5, and the locking portions 11 of the housing 5 are brought into engagement with the locking portions 13 of the rear holder 3 (refer to FIG. 6).

Following this, the shell 9 is installed on the housing 5 from the rear of the housing 5, and the locking portions 11 of the housing 5 are brought into engagement with the locking portions 15 of the shell 9 (refer to FIG. 6).

According to the connector 1, the seal materials 7 are prevented from being dislodged from the housing 5. The rear holder 3 which holds the electric wires 17 is provided integrally on the housing 5 with the locking portions 13 locked on the locking portions 11 of the housing 5, and the shell 9 is provided integrally on the housing 5 with the locking portions 15 locked on the locking portions (the locking portions on which the locking portions 13 of the rear holder 3 are locked) 11 of the housing 5. By this configuration, the reduction in waterproofness (sealing capability) of the seal materials 7 can be prevented which would otherwise occur when the electric wires 17 are bent with the simple configuration.

Namely, since the electric wires 17 are held by the rear holder 3, the force generated by the bending of the electric wires 17 is interrupted by the rear holder 3, and hence, there is almost no such situation that the force is transmitted as far as the seal materials 7. Thus, there is almost no such situation that the seal materials 7 are deformed. Then, the reduction in sealing capability of the seal materials 7 can be prevented which would otherwise occur due to the bending of the electric wires 17. In addition, since the locking portions 11 of the housing 5 are used commonly to lock the locking portions 13 of the rear holder 3 and the locking portions 15 of the shell 9, the configuration of the connector 1 can be made simple, and the enlargement in size of the connector 1 can be prevented.

In addition, according to the connector 1, since the dislodgement of the rear holder 3 from the housing 5 is restricted by the shell 9, the rear holder 3 cannot be removed from the housing 5 without removing the shell 9 from the housing 5, thereby making it possible to increase the installation strength of the rear holder 3 onto the housing 5. In addition, even when an external force is exerted on the rear holder 3, the dislodgement of the rear holder 3 can be prevented in an ensured fashion. Thus, the force exerted on the electric wires 17 can be interrupted by the rear holder 3 in a more ensured fashion, thereby making it possible to prevent the transmission of the force exerted on the electric wires 17 as far as the seal materials 7 in a more ensured fashion.

Additionally, according to the connector 1, since the locking portions 15 of the shell 9 cover the locking portions 13 of the rear holder 3, the locking portions 13 of the rear holder 3 which are situated inside are protected by the locking portions 15 of the shell 9 which are situated outside. Thus, even in the event that the rigidity of the locking portions 13 of the rear holder 3 is not large (for example, even in the event that the locking portions 13 of the rear holder 3 are made smaller in size), the rear holder 3 is held firmly on the housing 5.

In addition, since the rear holder 3 and the locking portions 13 thereof are covered by the shell 9 (by the locking portions 15 of the shell 9), the damage or failure of the locking portions 13 of the rear holder 3 can be prevented which would otherwise occur due to the external force exerted thereon.

Further, according to the connector 1, the rear holder 3 projects further rearwards than the housing 5 and the shell 9 to thereby cover the circumferences of the electric wires 17, the damage to the electric wires 17 can be prevented which would otherwise occur due to the electric wires 17 being bent to be brought into contact with the housing 5 and the shell 9.

Additionally, according to the connector 1, since the locking portions 11 and the locking portions 13, 15 are provided individually between the insertion holes 19 and the through holes 31, the dead space can be made effective use of, whereby the connector 1 can be made smaller in size.

While the invention has been described in detail by reference to the specific embodiment, it is obvious to those skilled in the art to which the invention pertains that various alterations or modifications can be made to the invention.

This patent application is based on Japanese Patent Application (No. 2009-201634) filed on Sep. 1, 2009, the contents of which are to be incorporated herein by reference.

REFERENCE SIGNS LIST

1 connector
3 rear holder
5 housing
7 seal material (rubber plug)
9 shell
11 locking portion (of housing)
13 locking portion (of rear holder)
15 locking portion (of shell)
17 electric wire
19 insertion hole
31 through hole
37 accommodating portion.

The invention claimed is:

1. A connector, comprising:

a housing including a locking portion and an insertion hole into which an electric wire is inserted;

a seal material, formed in an annular shape, inserted into the insertion hole of the housing, and into which the electric wire is inserted, a rear holder, provided integrally on the housing, and including:

a through hole through which the electric wire penetrates; and a rear holder locking portion which is brought into engagement with the locking portion of the housing, and locked on the locking portion of the housing so as to prevent the seal material inserted in the insertion hole of the housing from being dislodged from the housing and to support the electric wire which penetrates through the through hole and the insertion hole in the housing; and a shell, including an accommodating portion which accommodates the housing and the rear holder in an interior thereof and a shell locking portion which is brought into engagement with the locking portion of the housing, wherein the accommodating portion accommodates the housing and the rear holder and the shell locking portion is locked on the locking portion of the housing on which the rear holder locking portion is locked so that the shell is provided integrally on the housing.

2. The connector according to claim 1, wherein the shell restricts the dislodgement of the rear holder from the housing.

3. The connector according to claim 1, wherein the rear holder projects further than the housing and the shell so as to cover the circumference of the electric wire on a side where the electric wire extends.

4. A connector according to claim 1, wherein a plurality of insertion holes into which a plurality of electric wires are inserted are aligned in the housing, a plurality of through holes into which the plurality of electric wires are inserted are aligned in the rear holder, and a plurality of locking portions are provided and are disposed between the insertion holes at an outer periphery of the housing.

* * * * *